US005176365A

United States Patent [19]

Best

[11] Patent Number: 5,176,365

[45] Date of Patent: Jan. 5, 1993

[54] VAULT DOOR OPENER

[75] Inventor: Glenn D. Best, Oklahoma City, Okla.

[73] Assignee: Oklahoma Gas & Electric Co., Oklahoma City, Okla.

[21] Appl. No.: 713,548

[22] Filed: Jun. 7, 1991

Related U.S. Application Data

[63] Continuation of Ser. No. 441,709, Nov. 27, 1989, abandoned.

[51] Int. Cl.[5] ..... B66D 3/12

[52] U.S. Cl. ..... 254/342; 242/106; 248/500; 254/376; 254/262; 254/266

[58] Field of Search ..... 254/262, 266, 264, 342; 242/106; 248/499, 500, 600

[56] References Cited

U.S. PATENT DOCUMENTS

| | | | |
|---|---|---|---|
| 2,331,060 | 10/1943 | Turner | 248/500 |
| 3,595,497 | 7/1971 | Boatright | 242/106 X |
| 3,671,015 | 6/1972 | Sullivan | 254/332 |
| 3,751,866 | 8/1973 | Renchen | 248/500 X |
| 3,946,990 | 3/1976 | Tanner | 254/266 |
| 3,964,729 | 6/1976 | Harlow | 254/264 X |
| 3,998,402 | 12/1976 | Christensen et al. | 242/106 |
| 4,181,290 | 1/1980 | Affolter | 254/124 |
| 4,275,939 | 6/1981 | Odermann | 248/680 X |
| 4,482,182 | 11/1984 | Mortensen | 254/131 X |
| 4,488,706 | 12/1984 | Kono | 254/131 |
| 4,490,088 | 12/1984 | Castle | 254/131 X |
| 4,512,554 | 4/1985 | Racine | 254/131 |
| 4,695,037 | 9/1987 | Hadbavny | 254/131 |
| 4,706,939 | 11/1987 | Gagne | 254/332 |
| 4,826,388 | 5/1989 | Golding | 254/131 X |

*Primary Examiner*—Katherine Matecki

*Attorney, Agent, or Firm*—Dunlap, Codding & Lee

[57] ABSTRACT

A vault door opener for opening a vault door wherein the vault door is disposed near a grating. The vault door opener comprises a stand with a winch connected to one end of the stand. Means are connected to the opposite end of the stand for removably connecting the stand to the grating whereby the stand is supported in an upright position on the grating. In the supported position of the stand, a cable on the winch is connected to the vault door and the winch is rotatable to reel the cable in thereby lifting the vault door to the opened position.

6 Claims, 2 Drawing Sheets

VAULT DOOR OPENER

This is a continuation of co-pending application Ser. No. 441,709 filed on Nov. 27, 1989, entitled "VAULT DOOR OPENER", now abandoned.

FIELD OF THE INVENTION

The present invention relates to a vault door opener for opening a vault door disposed near a grating comprising a stand removably connectable to the grating for supporting the stand in the upright position and winch means on the stand with a cable connectable to the vault door for lifting the vault door to the opened position.

BRIEF DESCRIPTION OF THE DRAWINGS

Shown in FIG. 1 is a partial perspective view showing the vault door opener of the present invention removably connected to a grating and with the cable portion of the vault door opener connected to the vault door, the vault door being shown in a partially opened position.

DESCRIPTION OF THE PREFERRED EMBODIMENTS

Power companies such as electric companies commonly dispose transformers underground. Access to the underground transformer is provided via a vault door. A grating generally is disposed over a portion of the underground transformer. The grating is disposed generally near the vault door. Such installations are commonly located in remote locations and the vault doors are heavy and very difficult to lift to the opened position for gaining access to the underground transformer. The present invention provides a means for conveniently and quickly opening the vault door.

Figure 1:
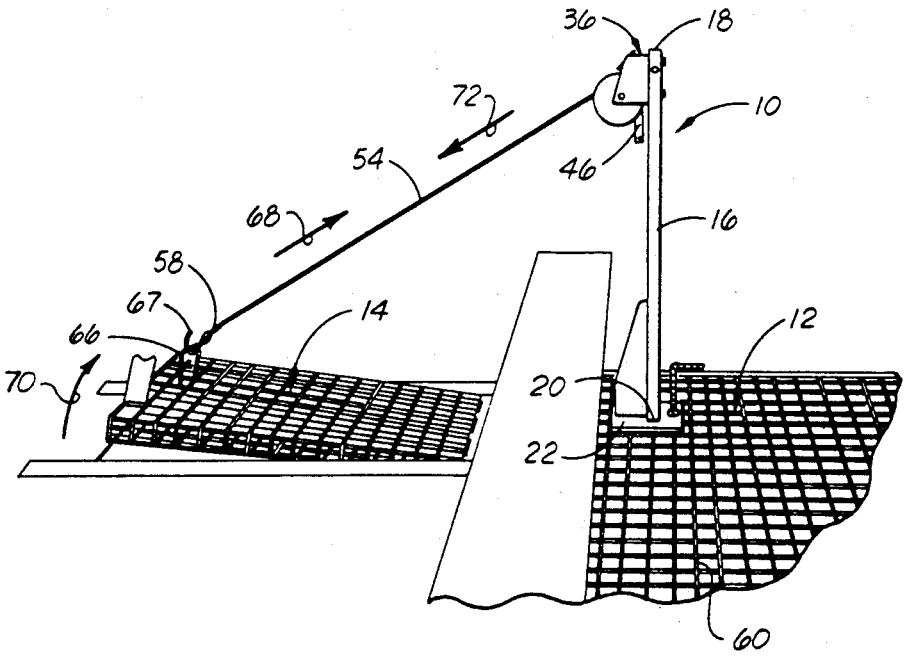
Figure 2:
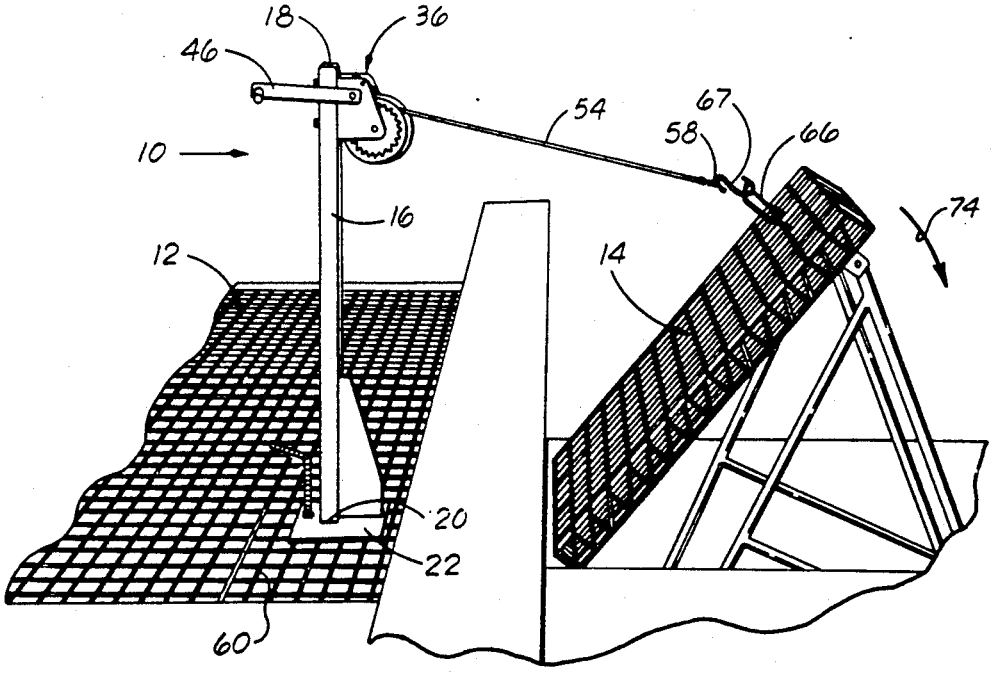
FIG. 2 is is a partial perspective view showing the vault door opener of the present invention removably connected to a grating and with the cable portion of the vault door opener connected to the vault door, the vault door being shown in the opened position.

Shown in FIG. 1 is a vault door opener 10 constructed in accordance with the present invention. The vault door opener 10 is shown in FIG. 1 removably connected to a grating 12. The vault door opener 10 is supported on the grating 12 and includes a portion which is connected to a vault door 14. The vault door 14 is shown in FIG. 1 in a partially opened position. By actuating the vault door opener 10, the vault door opener 10 lifts the vault door 14 to the opened position shown in FIG. 2.

Figure 3:
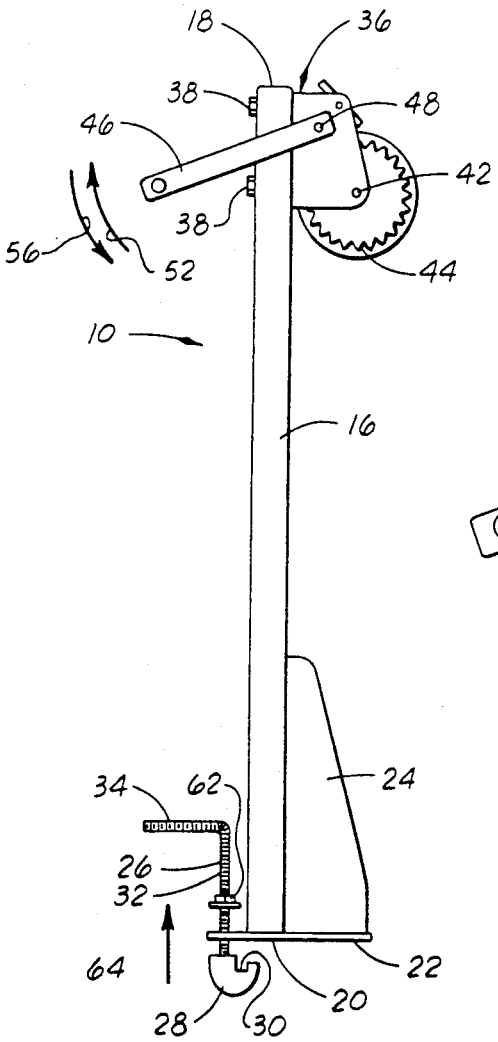
FIG. 3 is a side elevational view of the vault door opener shown in FIGS. 1 and 2.
Figure 4:
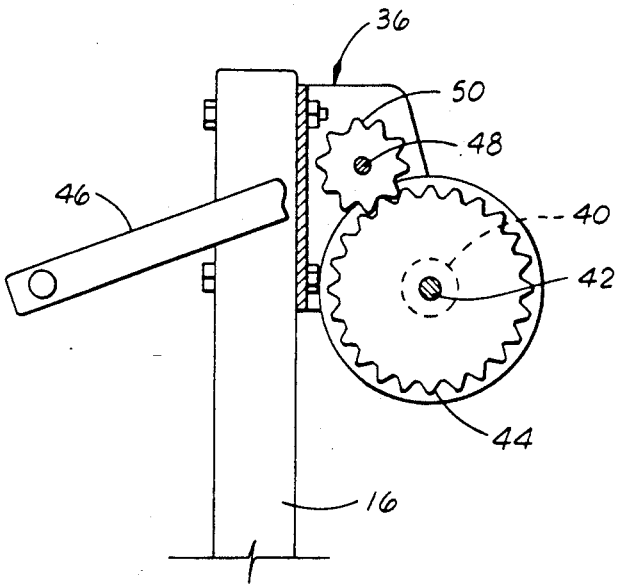
FIG. 4 is a partial elevational, partial sectional view showing a cutaway view of the winch assembly.
Figure 5:
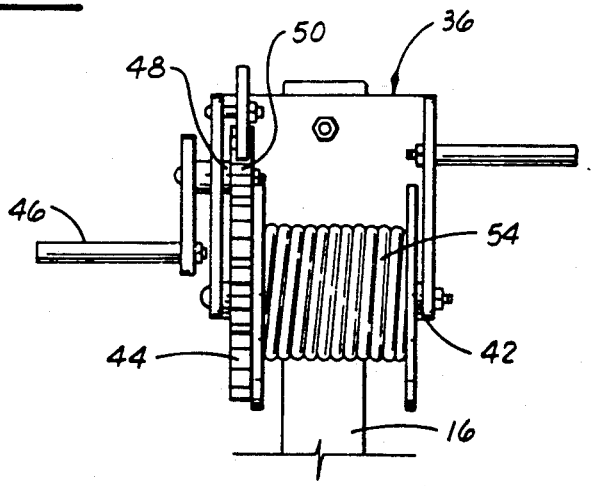
FIG. 5 is a front elevational view of the winch assembly connected to the stand with the stand being partially shown.

As shown in FIGS. 3, 4 and 5, the vault door opener 10 comprises a stand 16 having an upper end 18 and a lower end 20. A base 22 (FIGS. 1, 2 and 3) is connected to the lower end 20 of the stand 16. A portion of a gusset 24 (FIG. 3) is connected to the stand 16 and another portion of the gusset 24 is connected to the base 12. The gusset 24 cooperates with the base 22 to provide structural integrity for supporting the stand 16 in the upright position during the operation thereof.

One end of rod 26 (FIG. 3) is connected to a hook 28 (FIG. 3) having a recessed hook portion 30 (FIG. 3). The hook portion 30 is sized to receive one of the grates in the grating 12. The rod 26 includes a threaded portion 32 (FIG. 3) and the upper end of the rod 26 is formed at an angle thereby forming a handle 34 (FIG. 3).

A winch base 36 is secured to the upper end 18 of the stand 16 via a plurality of fasteners 38 (FIG. 3) extending through the stand 16 and the winch base 36. A winch cylinder 40 (FIG. 4) is rotatingly connected to the winch base 36 via a winch shaft 42 (FIGS. 3, 4 and 5).

A gear 44 (FIGS. 3, 4 and 5) is secured to the winch shaft 42 and is positioned generally between the winch cylinder 40 and one side of the winch base 36.

One end of a winch handle 46 is rotatingly connected to the winch base 36 via a shaft 48 (FIGS. 3, 4 and 5). A gear 50 (FIGS. 4 and 5) is secured to one end of the shaft 48, opposite the end secured to the winch handle 46. The gear 50 meshingly engages the gear 44.

When the winch handle 46 is rotated in one direction 52 (FIG. 3) the rotating motion is transferred to the winch shaft 42 via the gears 44 and 50 thereby causing a cable 54 (FIGS. 1, 2 and 5) to be reeled generally upon the winch cylinder 40. When the winch handle 46 is rotated in an opposite direction 56 (FIG. 3), the winch cylinder 40 is rotated in the opposite direction thereby causing the cable 54 to be unreeled from the winch cylinder 40.

One end of the cable 54 is connected to the winch cylinder 40 and an opposite end 58 (FIGS. 1 and 2) of the cable 54 is extendable from the winch cylinder 40.

In operation, the vault door opener 10 is generally positioned on the grating 12 in a position whereby the base 22 generally is disposed on the grating 12. The rod 26 with the hook 28 connected thereto is extended downwardly through openings in the grating 12 to a position wherein the hook 28 is disposed generally under one of the grates 60 (FIGS. 1 and 2) in the grating 12. In this position, the handle 34 is rotated through a nut 62 (FIG. 3) thereby causing the hook 28 to be moved in an upward direction 64 (FIG. 3) to a position wherein a portion of the grate 60 is disposed generally in the hook portion 30 of the hook 28 thereby removably and securingly connecting the base 22 to the grating 12.

After the stand 16 has been removably secured to the grating 12, the cable 54 is unreeled from the winch cylinder 40 to a position wherein the end 58 of the cable 54 extends outwardly from the winch cylinder 40 to a position wherein the end 58 is disposed generally near a handle 66 (FIGS. 1 and 2) secured to the vault door 14. The end 58 of the cable 54 is removably connected to the handle 66 on the vault door 14 via a hook 67 (FIGS. 1 and 2) connected to the handle 66 and the end 58 of the cable 54. After the cable 54 has been secured to the handle 66, the winch handle 46 is rotated in the direction 52 thereby pulling the cable in a direction 68 (FIG. 1) and reeling a portion of the cable 54 generally onto the winch cylinder, 40. As the winch handle 46 is rotated in the direction 52 and the cable 54 is pulled in the direction 68, the vault door 14 is moved in the upwardly direction 70 (FIG. 1) thereby moving the vault door 14 from the closed position to the opened position (shown in FIG. 2).

When it is desired to move the vault door 14 from the opened position to the closed position, the winch handle 46 is rotated in the direction 56 thereby unreeling cable from the winch cylinder 40 and permitting the cable 54 to move in the direction 72 (FIG. 1) thereby lowering the vault door 14 in a direction 74 (FIG. 2) from the opened position to the closed position. When the vault door 14 has been moved to the closed position, the cable 54 is disconnected from the handle 66. The rod 26 then is rotated by moving the handle 34 portion thereof to lower the hook 28 to a position wherein the hook portion 30 is disconnected from the grate 60. In this position, the hook 28 is removed from the grating 12 thereby disconnecting the vault door opener from the grating 12.

It should be noted that, in some instances, the vault door 14 already may include an existing handle 66. In other instances, a handle 66 may have to be connected to the vault door 14. If there is no handle 66, the end 58 of the cable 54 can be connected to the vault door 14 by tying the end 58 generally about the grate 60.

Changes may be made in the construction and the operation of the various components, elements and assemblies described herein without departing from the spirit and scope of the invention as defined in the following claims.

What is claimed is:

1. A portable vault door opener for opening a vault door disposed near a grating having a plurality of grates comprising:

a stand having an upper end and a lower end;

a winch means connected to the stand generally near the upper end thereof having a cable disposed thereon with an end, the winch means being rotatable in one direction for reeling the cable onto the winch means and the winch means being rotatable in one other direction for unreeling the cable from the winch means;

a base connected to the lower end of the stand for supporting the stand on the grating, the base extending a distance perpendicularly from the stand; and means connected to the stand for removably connecting the stand to the grating whereby the stand is supported in an upright position on the grating, the end of the cable being connectable to the vault door and the winch means being rotatable for reeling the cable onto the winch means thereby lifting the vault door to an opened position, comprising:

a threaded rod engaged with the base, the threaded rod having opposite ends with one end of the threaded rod extending a distance above the base and the opposite end of the threaded rod extending a distance below the base, the threaded rod being movable in an upward and a downward direction with respect to the base, means for threadedly engaging said one end of said threaded rod for causing movement thereof in said upward and downward directions; and a U-shaped hook having opposite ends with one end of the hook being connected to the end of the rod disposed below the base, the U-shaped hook forming a recessed hook portion facing the base, the threaded rod being movable in a downward direction from the base to a position wherein the recessed hook portion is disposed generally under one of the grates in the grating and then movable in upward direction for disposing the grate in the recessed hook portion whereby the stand is removably connected to the grate in the grating the hook pulling the base toward the grating as the hook is moved in the direction for disposing the grate in the recessed hook portion for removably securing the base on the grating.

2. The vault door opener of claim 1 wherein the winch means further comprises:

a winch base connected to the stand generally near the upper end of the stand;

a winch cylinder rotatably supported on the winch base with at least a portion of the cable being disposed about the winch cylinder; and a winch handle rotatably connected to the winch cylinder for rotating the winch cylinder in one direction for reeling cable onto the winch cylinder and for rotating the winch cylinder in the opposite direction for releasing cable from the winch cylinder.

3. The vault door opener of claim 2 wherein the winch means further comprises:

gear means connected to the winch handle and the winch cylinder for connecting the winch handle to the winch cylinder.

4. The vault door opener of claim 1 further comprising:

means for removably connecting the end of the cable to the vault door.

5. A method for opening a vault door disposed near a grating having a plurality of grates comprising:

providing a vault door opener having a stand with an upper and a lower end and a winch means connected to the upper end of the stand having a cable disposed thereon with an end and wherein the winch means is rotatable in one direction for reeling a cable onto the winch means and wherein the winch means is rotatable in one other direction for unreeling the cable from the winch means, the vault opener having a base connected to the lower end of the stand and extending a distance perpendicularly from the stand with a threaded rod extending through the stand with one end of the threaded rod extending a distance upwardly above the stand and the opposite end of the threaded rod extending a distance downwardly below the stand and with a U-shaped hook having opposite ends with one end of the hook being connected to the end of the threaded rod extending below the base, the U-shaped hook forming a recessed hook portion facing the base;

disposing the base on the grating with the hook being extended through the grating and disposed generally under one of the grates with the recessed hook portion facing one of the grates; and moving the threaded rod in the upward direction thereby moving the hook portion toward the grate and moving the hook to a position wherein one of the grates is disposed in the recessed hook portion of the hook and moving the threaded rod further in the upward direction for pulling the base toward the grating as the hook is moved toward the grating in the upward direction for disposing the grate in the recessed hook portion thereby removably connecting the vault door opener to the grating;

connecting the end of the cable to the vault door; and rotating the winch means in the one direction for reeling the cable onto the winch means whereby the vault door is lifted to the opened position.

6. The method of claim 5 further comprising:

rotating the winch cable in the direction for unreeling the cable from the winch means thereby lowering the vault door to the closed position;

disconnecting the cable from the vault door; and disconnecting the stand from the grating.

* * * * *

UNITED STATES PATENT AND TRADEMARK OFFICE

CERTIFICATE OF CORRECTION

PATENT NO. : 5,176,365

DATED : January 5, 1993

INVENTOR(S) : Glenn D. Best

It is certified that error appears in the above-identified patent and that said Letters Patent is hereby corrected as shown below:

Column 1, line 23, after is, please delete duplicate "is".

Column 3, line 63, after in, please insert the word --an--.

Column 3, line 66, after grating, please insert --,--.

Column 4, line 34, after vault, please insert the word --door--.

Signed and Sealed this

Twenty-third Day of November, 1993

*Attest:*

Bruce Lehman

BRUCE LEHMAN

*Attesting Officer*

*Commissioner of Patents and Trademarks*